United States Patent [19]

Blokland

[11] 4,411,330

[45] Oct. 25, 1983

[54] STAIR-CLIMBING APPARATUS FOR A WHEEL CHAIR OR SIMILAR MOBILE TRANSPORT MEANS

[75] Inventor: Adriaan Blokland, Breda, Netherlands

[73] Assignee: J. de Reus B.V., Netherlands

[21] Appl. No.: 294,541

[22] Filed: Aug. 20, 1981

[30] Foreign Application Priority Data

Aug. 21, 1980 [NL] Netherlands ..... 8004743

[51] Int. Cl.[3] ..... A61G 5/04

[52] U.S. Cl. ..... 180/8 A; 180/9.44; 180/198; 180/DIG. 3; 280/5.22; 280/5.3; 280/DIG. 10

[58] Field of Search ..... 180/8 A, 6.5, 9.24 R, 180/9.44, 198, DIG. 3; 280/5.22, 5.28, 5.3, DIG. 10

[56] References Cited

U.S. PATENT DOCUMENTS

| | | | |
|---|---|---|---|
| 3,231,036 | 1/1966 | Appenrodt | 280/5.22 |
| 3,823,790 | 7/1974 | Richison et al. | 180/9.23 |
| 3,869,011 | 3/1975 | Jenson | 180/9.23 |
| 3,926,272 | 12/1975 | Weber | 180/198 |
| 4,121,788 | 10/1978 | McMahon | 180/198 |
| 4,194,584 | 3/1980 | Kress et al. | 180/9.23 |

FOREIGN PATENT DOCUMENTS 1405731 6/1969 Fed. Rep. of Germany .

*Primary Examiner*—Joseph F. Peters, Jr.
*Assistant Examiner*—Kenneth R. Rice
*Attorney, Agent, or Firm*—Bernard, Rothwell & Brown

[57] ABSTRACT

A stair-climbing apparatus for a wheel chair or the like mobile transport means, which apparatus is provided with an undercarriage, a plurality of pulleys mounted in the undercarriage, at least one endless track extending along a way defined by at least two pulleys, a drive mechanism adapted for engagement of at least one of the pulleys and a frame for supporting the wheel chair or a similar mobile transport means, whereby the frame comprises a platform which relatively to the undercarriage is adapted for swiveling movement about a shaft extending at the climbing side of the undercarriage parallel to the pulley axes through drive means adapted for coaction with a steering mechanism which is adapted for keeping the platform horizontal independently of the position of the undercarriage. The drive mechanism is retarded when the platform deviates a set angle from the horizontal.

4 Claims, 2 Drawing Figures

STAIR-CLIMBING APPARATUS FOR A WHEEL CHAIR OR SIMILAR MOBILE TRANSPORT MEANS

Figure 1:
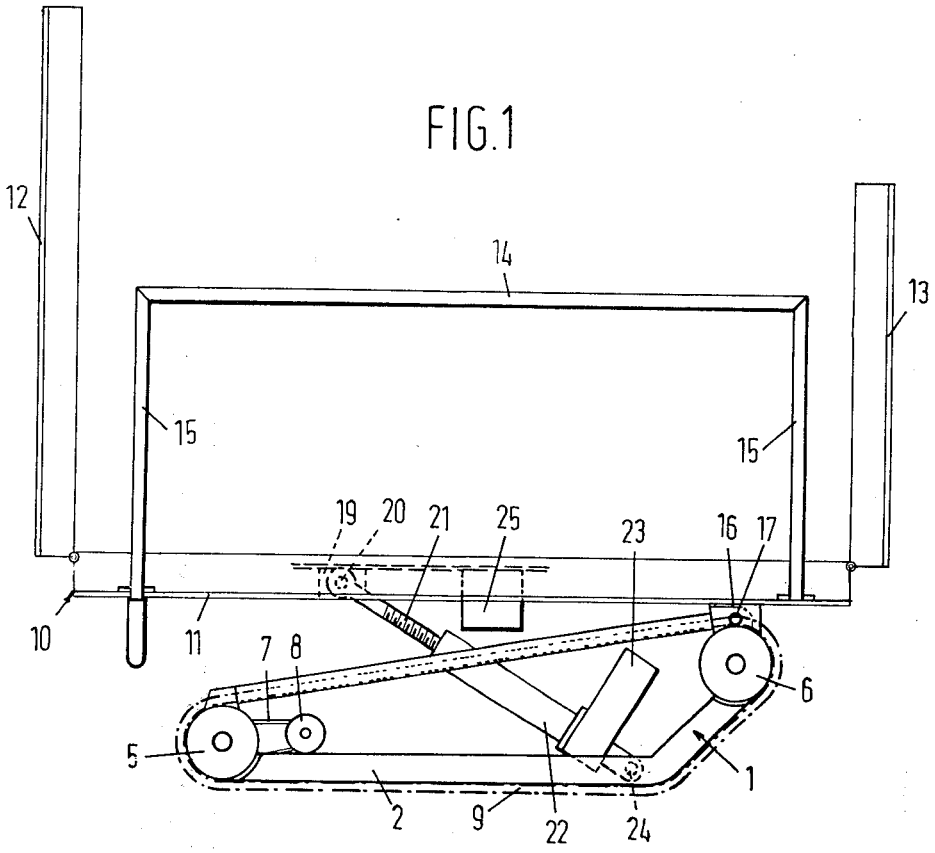

The invention relates to a stair-climbing apparatus for a wheel chair or the like mobile transport means, which apparatus is provided with an undercarriage, a plurality of pulleys mounted in the undercarriage, at least one endless caterpillar track extending along a path defined by at least two pulleys, a driving device which is adapted to drive at least one of the pulleys and a frame for supporting the wheel chair or a similar mobile transport means.

In such a prior apparatus a frame is disposed on the tracked undercarriage which comprises a frame portion connectible to the back and the wheels of a wheel chair and a sliding portion connected at an angle rigidly to the frame portion, which sliding portion is adapted for coaction with guiding and stopping ways.

By sliding the frame in its one outer position, the sliding portion is brought in a position allowing tilting of the frame, so that the frame portion can be connected to the back of the wheel chair, whereby the wheels of the wheel chair should find support against a pair of laterally extending tube portions of the frame portion. This attachment method entails a number of drawbacks. In view of the great variety existing in the field of wheel chairs, a number of wheel chairs will not be suitable for thus being reliably coupled to the frame. For instance, a wheel chair to be coupled should be provided with sufficiently stable and accessible supporting points in its back. In practice this implies that wheel chairs whose grips are removable at the top side of the back cannot be coupled to the frame in the desired manner. Furthermore the necessity of abutment of the wheels of the wheel chair against the protruding tube portions means that the stair-climbing apparatus is only usable for wheel chairs whose wheel diameters lie in a restricted range.

After the coupling of a suitable wheel chair to the frame, this should be tilted backwards together with the wheel chair until the sliding direction of the sliding portion runs parallel to the sliding direction of the guiding ways. The frame with coupled backwardly tilted wheel chair should then be pushed to the other outer position and be stopped in this position. By switching on the driving device, the stair-climbing apparatus can be driven towards the stair after which through coaction between steps and tracks the stair-climbing apparatus is moved upwards or downwards along the stair, whereby the portion of the guiding ways to which the frame is coupled should always be present adjacent the undercarriage portion then having the highest position on the stair. Through the then inclined position of the undercarriage, the wheel chair will come in a more or less horizontal position depending on the angle of inclination of the stair. This now means that the passenger transported in the wheel chair, from the tilting of the frame to minimally the time when the stair-climbing apparatus is entirely present on the stair, is positioned in an extremely inconvenient and submissive condition, which position in case of relatively flat stairs continues to be maintained partly. After leaving the stair the undercarriage again returns in its horizontal position, which again brings the transported passenger in the hardly enviable backwardly inclined position, until the drive is disconnected, the frame is pushed to its other outer position and is tilted forwardly. It is the object of the invention to render the stair-climbing apparatus substantially independent of the type of wheel chair to be transported or the like mobile transport means, consequently to render same suitable for all possible vehicles provided with wheels, and thereby to also keep this transported conveying means along the entire transport path as much as possible in horizontal position.

This is achieved according to the invention with a stair-climbing apparatus of the above described type when the frame comprises a platform which relatively to the undercarriage is pivotal about a shaft extending at the climbing side of the undercarriage parallel to the pulley axes by means of driving means which coact with a steering mechanism which is adapted to keep the platform horizontal independently of the position of the undercarriage. Through these features it becomes possible to position any wheel vehicle on the platform in order to bring same up and/or down a stair, whereby during the transport movement the control mechanism subjects the platform to such a pivoting movement that this, and hence the vehicle placed thereon, will always be in an at least substantially horizontal position. A further advantage of the platform is that this allows in principle movement up and down on two sides. This is especially advantageous when a stair terminates in a relatively narrow passage where the prior art apparatus provides additional difficulties, since this has to be turned in order to deposit the wheel chair, seen in the driving direction, behind the stair-climbing apparatus.

Although different methods are possible for depositing or removing a wheeled vehicle from the platform, it is preferable according to one embodiment of the invention that the platform is provided with at least one folding drive-up and drive-off platform. This enables the stair-climbing apparatus to be stopped adjacent the top end of the stair and after the folding down of a platform mounted in the climbing direction to the front of the platform, to drive off the wheel chair at floor level from the stair-climbing apparatus. In such an embodiment it is likewise possible advantageously to avoid by means of switching contacts that the driving device is activated as long as a platform is not yet in a folded-back, locked position, which offers an additional protection.

The pivoting of the platform can be realized with many means, such as with hydraulic or pneumatic cylinders, chains, ropes, racks and pinions etc. However it is preferred that the driving means consist of a motor and a drivable screwed spindle, the one end of which is pivotally connected to the platform and which is adapted for coaction with a counter element which is connected to the undercarriage, since such a drive in case of failure of the power source, has a self-braking effect.

If in accordance with a further embodiment of the invention the steering mechanism is adapted for transmitting a signal which is adapted for influencing besides the driving means likewise the driving device, in such a way that the drive of the stair-climbing apparatus is delayed according as the angle enclosed by the platform with the horizontal becomes larger, the comfort of the stair-climbing apparatus is still increased in that inter alia the transition from a flat floor to a stair inclination is traversed in an impact-free and flexible manner. It is preferred thereby that the steering mechanism disconnects the drive when a given value of said angle is exceeded and the drive is not influenced underneath a given value of said angle, whereby in practice an optimum is attained when the values of said angle are respectively 6°–8° and 2°–3°.

Figure 2:
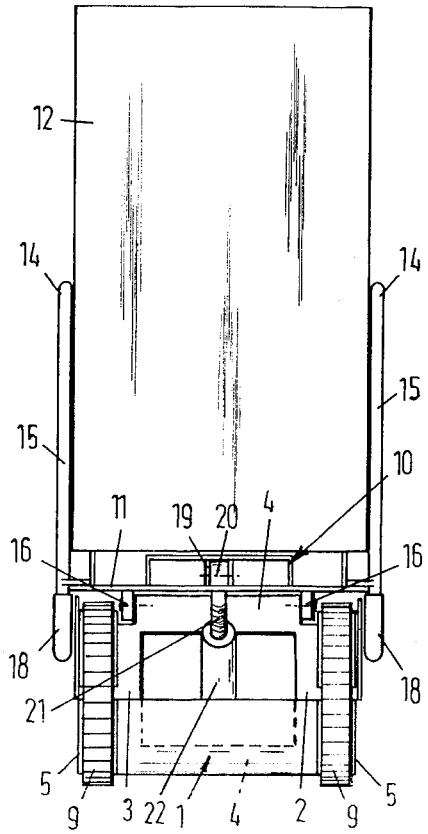

One embodiment of the stair-climbing apparatus according to the invention will now be described, by way of example, with reference to the accompanying diagrammatic drawing, wherein:

FIG. 1 is a side view of the stair-climbing apparatus according to the invention; and FIG. 2 is a rear view of the stair-climbing apparatus according to FIG. 1.

The stair-climbing apparatus shown on the drawing is provided with an undercarriage 1 fitted with two slide-shaped girders 2 and 3 which are connected by a plurality of transverse girders 4. In the slide-shaped girders 2 and 3 respectively, there is mounted a drive pulley 5 and a bend pulley 6. The drive pulleys 5 are drivable through a reduction gearbox 7 by a motor 8 which is mounted on one or both slide-shaped girders. Around a drive pulley 5 and a bend pulley 6 mounted on the same slide-shaped girder there runs a track 9, while the bottom side of a slide-shaped girder constitutes a guide and support way for the track 9 passing therealong. At the outer side the track 9 is provided with transversely extending ribs adapted for engagement on the treads of a stair to be ascended or descended. At the inner side the track 9 is provided with tooth-shaped projections adapted for engagement with corresponding projections on the outer circumferential face of the drive pulley 5.

On the undercarriage 1 there is positioned a frame 10 consisting of a platform 11 and platforms 12 and 13 hinged thereto. Furthermore, a rail 14 is secured on the platform via two standards 15, while two standards are extended to handles 18 extending underneath the platform, by means of which the stair-climbing apparatus can be steered when this is present on a long and/or steep stair. The steering person will then be present behind the stair-climbing apparatus, seen in the climbing direction.

At the bottom side of the platform 11 there is secured a support 16 which is connected through a pivot 17 to a transverse girder 4 which forms a connection between the overhead ends of the two slide-shaped girders. A second support 19 secured to the bottom side of the platform 11 is coupled via a pivot 20 to a screwed spindle 21 which is partly received in a counter-element 22. The screwed spindle 21 and the counter-element 22 are mutually rotatable by means of a motor 23 which, together with the counter-element, is hingedly connected about a shaft 24 to the undercarriage 1.

To the platform there is secured furthermore a steering mechanism 25 which, depending on the inclination made by the platform 11 relatively to the horizontal, is adapted for transmitting a control signal which causes the motor 23 to rotate clockwise or counter-clockwise in order to bring and/or maintain the platform 11 in a substantially horizontal position.

Besides, the control signal also influences the drive motor 8 progressively, i.e. the larger the angle between the horizontal and the platform 11, the lower becomes the advancing speed of the stair-climbing apparatus, on the understanding that when a given angle is exceeded, e.g., 6°–8°, the drive motor is stopped. On the other hand, a relatively small deviation from the horizontal, e.g. less than 2°–3°, will have no influence on the drive motor 8. Through this arrangement the comfort of the transported passenger is optimally enhanced, inter alia in that the transition from a flat floor to a stair gradient takes place shock-free and smoothly.

The operation of the above described stair-climbing apparatus is as follows:

For moving a wheel chair or similar wheel vehicle on the platform, one of the platforms, e.g. 12, is to be swung down so that this constitutes an ascent for the wheel chair. To facilitate in this case the ascending movement, the platform 11 may be brought in a position parallel to the upper part of a track. The wheel chair on the platform 11 is moved as much as possible towards the platform 13 and secured in situ with appropriate means. After raising and locking the platform 12 the drive may be engaged, while the steering mechanism 25 transmits a signal which activates the motor 23 until the platform 11 is in a horizontal position. During or after this horizontal positioning of the platform 11, the drive motor 8 may be activated, and the stair-climbing apparatus can be moved in the direction of a stair. In case the respective stair has to be ascended, the bend pulley 6 should be oriented towards the stair. In case of descent, the drive pulley 5 should face the stair. By coaction of the ribs on the tracks with the treads, the stair-climbing apparatus can be moved in the desired direction over and along the stair.

In case a stair is ascended, the stair-climbing apparatus can be stopped before attaining the top of the stair, viz. when the pivot between the platform 11 and the platform 13 is at the level of the upper tread. After the lowering of the platform 13, the wheel chair can be driven away from the platform 11 at floor level via the platform 13.

Naturally, many alterations and variants are possible within the scope of the invention. For instance, the lockings, not shown, of the platforms 12 and 13 may be provided with contacts which prevent the engagement of the drive when the platforms are not in the raised and locked position. Likewise, it is possible to replace the slide-shaped girders with bend pulleys 6 by straight girders with bend pulleys having a diameter that is twice or thrice as large as that of the drive pulley 5. The platform may furthermore be provided with grooves or guideways for the wheels of a wheel chair or the like transport means, as diagrammatically shown on the drawing. Such grooves or guideways may then be simply provided with locking means easily adaptable to the wheels. These locking means may naturally also be connected to the platform 13 and again be fitted with switching elements preventing the activation of the drive as long as the wheel chair has not been properly locked.

I claim:

1. A stair-climbing apparatus for a wheel chair or the like mobile transport means, which apparatus is provided with an undercarriage, a plurality of pulleys mounted on the undercarriage, at least one endless track extending along a way defined by at least two of the pulleys, a drive mechanism for driving at least one of the pulleys and a frame for supporting the wheel chair or other mobile transport means, characterized in that the frame comprises a platform, means for adjusting the position of the platform relative to the undercarriage for maintaining the platform in a substantially horizontal position, the adjusting means comprising an elongated element including a counter-element member and a screwed spindle member receivable in the counter-element member and rotatable relative to the counter-element member to adjust the length of said elongated element, one of the members being pivotably connected to the undercarriage and the other of the members being pivotably connected to the platform, a motor for driving the screwed spindle member for varying the length of the elongated element, and means for controlling the drive mechanism to retard the drive mechanism in response to deviation of the platform from the horizontal.

2. A stair-climbing apparatus according to claim 1, characterized in that the platform is provided with at least one hinged section for facilitating moving the wheel chair on or off the platform.

3. A stair-climbing apparatus according to claim 1, characterized in that the controlling means disconnects the drive mechanism when the deviation of the platform from the horizontal exceeds a first given angle and does not influence the drive mechanism when the deviation is below a second given angle.

4. A stair-climbing apparatus according to claim 3, characterized in that the value of said first given angle is 6°–8°, and the value of said second given angle is 2°–3°.

* * * * *